US012595952B2

(12) United States Patent
Hugo et al.

(10) Patent No.: US 12,595,952 B2
(45) Date of Patent: Apr. 7, 2026

(54) BAFFLE ASSEMBLY FOR A REFRIGERATION CONTAINER

(71) Applicant: REEFER AIR FLOW TECHNOLOGIES (PTY) LTD, Germiston (ZA)

(72) Inventors: Barry James Hugo, Edenvale (ZA); Malcolm Caulton Dodd, Claremont (ZA); Craig Wayne Osner, Germiston (ZA)

(73) Assignee: REEFER AIR FLOW TECHNOLOGIES (PTY) LTD, Germiston (ZA)

( * ) Notice: Subject to any disclaimer, the term of this patent is extended or adjusted under 35 U.S.C. 154(b) by 725 days.

(21) Appl. No.: 17/271,405

(22) PCT Filed: Aug. 30, 2019

(86) PCT No.: PCT/IB2019/057335
§ 371 (c)(1),
(2) Date: Feb. 25, 2021

(87) PCT Pub. No.: WO2020/044306
PCT Pub. Date: Mar. 5, 2020

(65) Prior Publication Data

US 2021/0341213 A1 Nov. 4, 2021

(30) Foreign Application Priority Data

Aug. 30, 2018 (ZA) ..... 201805820

(51) Int. Cl.
*B65D 88/74* (2006.01)
*F25D 17/06* (2006.01)

(52) U.S. Cl.
CPC ..... *F25D 17/06* (2013.01); *B65D 88/745* (2013.01); *B65D 2588/743* (2013.01); *F25D 2317/063* (2013.01)

(58) Field of Classification Search
CPC . F24D 17/06; F24D 2317/063; B65D 88/745; B65D 2588/743; B60H 1/00295;
(Continued)

(56) References Cited

U.S. PATENT DOCUMENTS 4,979,431 A 12/1990 Fujimoto et al.
5,584,430 A * 12/1996 Mulry ..... B65D 5/543 229/117.16

(Continued)

FOREIGN PATENT DOCUMENTS

JP H03109121 9/1991
WO WO2017115424 7/2017

OTHER PUBLICATIONS

Ishii, Makoto, WO2017115424 Translation.pdf, "Storage warehouse and temperature control system", Jul. 2017, pp. 1-16.*

(Continued)

*Primary Examiner* — Avinash A Savani
*Assistant Examiner* — Ryan L Faulkner
(74) *Attorney, Agent, or Firm* — Lee & Hayes, P.C.

(57) ABSTRACT

A baffle blank for a baffle assembly and a method for deploying the baffle assembly in a storage container for manipulating air flow in the container is provided. The baffle blank is made of stiff planar sheet material and has fold lines, cut lines and sulcations arranged to form a base, a deflector extending from the base along a hinge line, and an angle selector formed as cut-out in the baffle blank. The baffle blank is operable between a collapsed condition in which the base, deflector and angle selector lie in a substantially planar configuration, into a deployed baffle assembly in which the (Continued)

deflector is secured at a selected angle relative to the base by the angle selector with the angle selector extending between the base and deflector.

13 Claims, 8 Drawing Sheets

(58) Field of Classification Search
CPC ..... B60H 1/00271; B60H 1/00507; B60H 1/0055; B60H 2001/2293
USPC ..... 454/309
See application file for complete search history.

(56) References Cited

U.S. PATENT DOCUMENTS

| | | | | |
|---|---|---|---|---|
| 5,706,662 | A | 1/1998 | Van | |
| 8,596,518 | B2 * | 12/2013 | Babcock | B65D 5/443 229/199 |
| 11,589,689 | B2 * | 2/2023 | McGill | A47F 5/005 |
| 2009/0277952 | A1 * | 11/2009 | Smith | B65D 5/28 493/162 |
| 2010/0059579 | A1 * | 3/2010 | House | B65D 5/0254 229/182 |
| 2011/0204127 | A1 * | 8/2011 | Brundage | B65D 5/103 229/5.5 |
| 2017/0233132 | A1 * | 8/2017 | Smalley | B65D 5/62 206/427 |

OTHER PUBLICATIONS

PCT Search Report for corresponding PCT Application No. PCT/IB2019/057335 dated Jan. 9, 2020, 10 pages.

* cited by examiner

BAFFLE ASSEMBLY FOR A REFRIGERATION CONTAINER

CROSS-REFERENCE TO RELATED APPLICATIONS

This application is a US national stage application under 35 USC § 371 of PCT application PCT/IB2019/057335 filed on 30 Aug. 2019, which claims priority from South African provisional patent application number 2018/05820 filed on 30 Aug. 2018, which is incorporated by reference herein.

FIELD OF THE INVENTION

This invention relates to a baffle assembly for air flow manipulation within a refrigeration container.

BACKGROUND TO THE INVENTION

Refrigerated transport containers are widely used in industry to transport produce that need to maintain freshness. Such produce include fruit and vegetables that need to be kept at reduced temperatures in order to maintain said freshness and consequently the shelf life and marketability thereof. Strict standards regulate the temperature at which produce, such as fruit and vegetables, should be transported in order to ensure that the fruit and vegetables do not spoil and get rejected or discarded. Rejection or discarding of the produce may lead to substantial losses for the supplier and should be avoided. Uniform and controlled cooling of the refrigerated container's contents is therefore essential. Produce is typically transported in items such as pallets or the like which are packed and/or stacked in the container.

Most refrigeration containers typically have a standard layout, with a refrigeration unit thereof located at a front end of the container and doors to access the container at an opposite rear end. The refrigeration unit is responsible for cooling the container and the items therein by circulating cool air within the container. Such refrigeration units are typically located behind a panel at the one end, with an opening at the top of the panel for drawing air from the container, and an opening at the bottom for introducing cool air into the container by blowing.

Typical refrigeration containers have a floor which is referred to as a "T-bar" floor. A T-bar floor is a floor which is formed by T-shaped extrusions that are spaced apart along the length of the container. The purpose of the T-bar floor is to, when the container is loaded with produce, facilitate uniform cooling of the produce within the container by permitting cool air to flow between the extrusions along the length of the T-bar floor and then upwards through the produce before being drawn back into the refrigeration unit. However, in practice the produce within the container are not always packed or stacked to facilitate a suitable air flow therethrough. Gaps are typically present between produce and between the sides of the container. Additionally, the produce is generally not packed all the way to the roof and door of the container, which forms a gap along the top of the container and between the produce and the door. The gaps form a flow path for the cooled air introduced into and flowing within the container, and the path of least resistance is typically followed by air flowing within the container.

An undesired flow path is thus created, which may be such that air primarily travels from the refrigeration unit where it is introduced at the bottom at the front of the container, along the T-bar floor to the rear of the container, up along the back of the container, and returning all along the roof of the container where the air may be extracted from the container by the refrigeration unit. This results in cooled air moving around the stacked and packed items instead of through the items. This results in the produce not being suitably and uniformly cooled, which may result in spoiling thereof or damage thereto.

South African patent number 2009/00716 discloses a refrigeration container in which short-circuiting of the cooled air is avoided by covering the T-bar floor of the container with a sheet of metal or plastic which leads to an opening being present adjacent the doors and by covering and blocking the gaps between the produce and the roof and sides of the container with baffles. The baffles are in the form of inflatable bags or as sheets of a flexible material, referred to as a curtain. The cooled air thus travels from the refrigeration unit along the floor of the container and enters the opening between the doors and the produce. The air is then forced to flow through the produce as all other air flow paths are blocked. The produce may therefore be uniformly cooled and the problems stated above are addressed. However, even though the invention described in this patent appears to solve the cooling problem, it suffers the disadvantage that the baffles may be cumbersome and may be inconvenient to install. Furthermore, the inflatable bags may also be susceptible to damage and sharp edges of objects may puncture the bags and render them unusable. The bags also require a compressor for inflation, which may not be at hand.

The invention described herein aims to address, at least to some extent, the above-mentioned problems.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with an aspect of the invention there is provided a baffle assembly manufactured from stiff planar material for manipulating air flow in a container, comprising:

- a base configured to support the assembly in an air flow path in the container,
- a deflector hingedly extending from the base, and an angle selector for supporting the deflector at a selected angle relative to the base, wherein the baffle assembly is operable between a collapsed condition, in which the base, the deflector, and the angle selector lie in a substantially planar configuration, and a deployed condition in which the angle selector extends between the base and the deflector to support the deflector at the selected angle.

Further features provide for the base to include a plurality of fold sections forming a height adjustment mechanism; and for the height adjustment mechanism to be configured to increase a height of the base on a surface when at least one of the fold sections is in a substantially upright position.

Further features provide for the fold sections to have one or more notches defined at a side of each relevant fold section, such that at least some of the notches are aligned when the fold sections are in a stacked configuration; and for at least one of the plurality of fold sections to include a securing tab configured to be wedged into the aligned notches to secure the fold sections in a selected configuration.

Further features provide for the angle selector to have an at least partially arcuate shape and formed by a hinged cut-out provided on one of the base or the deflector, the other of which includes a complementary shaped aperture configured to receive the angle selector; for the angle selector to include a plurality of foldable angle selector tabs, each angle selector tab being operable to secure the deflector at the selected angle relative to the base by folding the tab transverse to the complementary shaped aperture; alternatively for the angle selector to include a plurality of teeth along an arcuate edge of the angle selector; and for each of the plurality of teeth to be configured to provide selectable position engagement with the complementary shaped aperture so as to secure the deflector at a selected angle relative to the base.

Further features provide for the angle selector to be integral with either the base or the deflector; and for there to be a plurality of angle selectors.

Further features provide for the baffle assembly to be provided as a planar blank of cardboard material; for the cardboard to be corrugated cardboard; and for fold lines to be provided on the blank to facilitate folding of the blank into the baffle assembly.

A further feature provides for the baffle assembly to include at least one covering unit having an opening for mounting each covering unit onto a corresponding angle selector to at least partially cover a void formed by the cut-out of the relevant angle selector.

Further features provide for either or both of the base and the deflector to be of a size that allows it to extend substantially across the width of a standard storage container; and for the storage container to be a refrigeration container.

Yet further features provide for the baffle assembly to include at least one anchor member allowing it to be secured on an item in the storage container; for the at least one anchor member to be cut from the deflector and to be at least partially releasable therefrom so that the at least one anchor member may be tucked behind a strap associated with the item; for the anchor member to include a plurality of securing formations defined by cutlines provided on the at least one anchor member allowing the strap to, when urged against at least one of the plurality of securing formations, offset the at least one of the plurality of securing formations and engage the anchor member so as to hold the anchor member in place; and for the cutlines to extend partially across the width of the anchor member and at an angle thereto.

Further features provide for the baffle assembly to include a plurality of assembly units that are at least partially connected to one another; for each assembly unit to be at least partially connected to an adjacent assembly unit by a frangible connection; for the frangible connection to be formed by a line of perforations; and for each of the assembly units to be foldable onto adjacent assembly units.

Further features provide for the deflector to be substantially rectangular in shape. At least one free corner of the deflector may be provided with a chamfer or a fillet. Alternatively, the free corner may be provided with a line of weakness or a perforated line for removing a section of the corner to form a chamfer or a fillet or provided with a fold to form a chamfer or a fillet at the free corner.

A still further feature provides for the items in the storage container to include pallets and boxes.

In accordance with a further aspect of the invention there is provided a baffle blank of stiff sheet material having one or more of fold lines, cut lines, perforations and sulcations arranged to define a base, a deflector extending from the base along a hinge line, and an angle selector formed as cut-out in the baffle blank, wherein the planar baffle blank is operable into a deployed baffle assembly in which the deflector is supported at a selected angle relative to the base by the angle selector with the angle selector extending between the base and deflector.

Further features provide for the base, the deflector and the angle selector to be integrally formed; and for the angle selector to be formed as a hinged cut-out in either the base or the deflector.

The invention extends to a method of deploying a baffle assembly in a storage container, the baffle assembly including a base configured to support the assembly in an air flow path in a container, and a deflector hingedly extending from the base at a selected angle relative thereto, the method including the steps of:

placing the baffle assembly on the base at least partially in an air flow path in the container; and folding the deflector about its hinge connection with the base to a selected angle relative to the base.

Further features provide for the baffle assembly to include an angle selector arranged for supporting the deflector at a selected angle relative to the base; and for the step of folding the deflector about its hinge connection with the base to a selected angle relative to the base includes using the angle selector to support the deflector at the selected angle relative to the base with the angle selector extending between the base and the deflector.

A further feature provides for the step of folding the deflector so that the angle selector extends from the either the base or the deflector partially through a complementary aperture provided in the other of the base or deflector.

Further features provide for the angle selector to be at least partially arcuate and to include a plurality of foldable angle selector tabs, each angle selector tab being operable to secure the deflector at the selected angle relative to the base; and for the step of securing the deflector at a selected angle relative to the base to include folding the angle selector tab transverse the complementary shaped aperture when the angle selector at least partially extends therethrough resulting in securing of the deflector at the angle relative to the base; and that the angle of the crease along which the angle selector tab is folded is at an acute angle relative to the radius extending from the hinge connection of the deflector to the arcuate edge of the angle selector such that once the angle selector tab has been folded more than 90° from its original position in the plane of the angle selector, the abutting deflector will need to be lifted off of it to allow it to return to its original position.

Still further features provide for the method to be performed so that the baffle assembly is installed at an operatively upper region of items in a storage container so as to at least partially block an air flow path along a top of the container.

An embodiment of the invention will now be described, by way of example only, with reference to the accompanying drawings.

DETAILED DESCRIPTION WITH REFERENCE TO THE DRAWINGS

Figure 1:
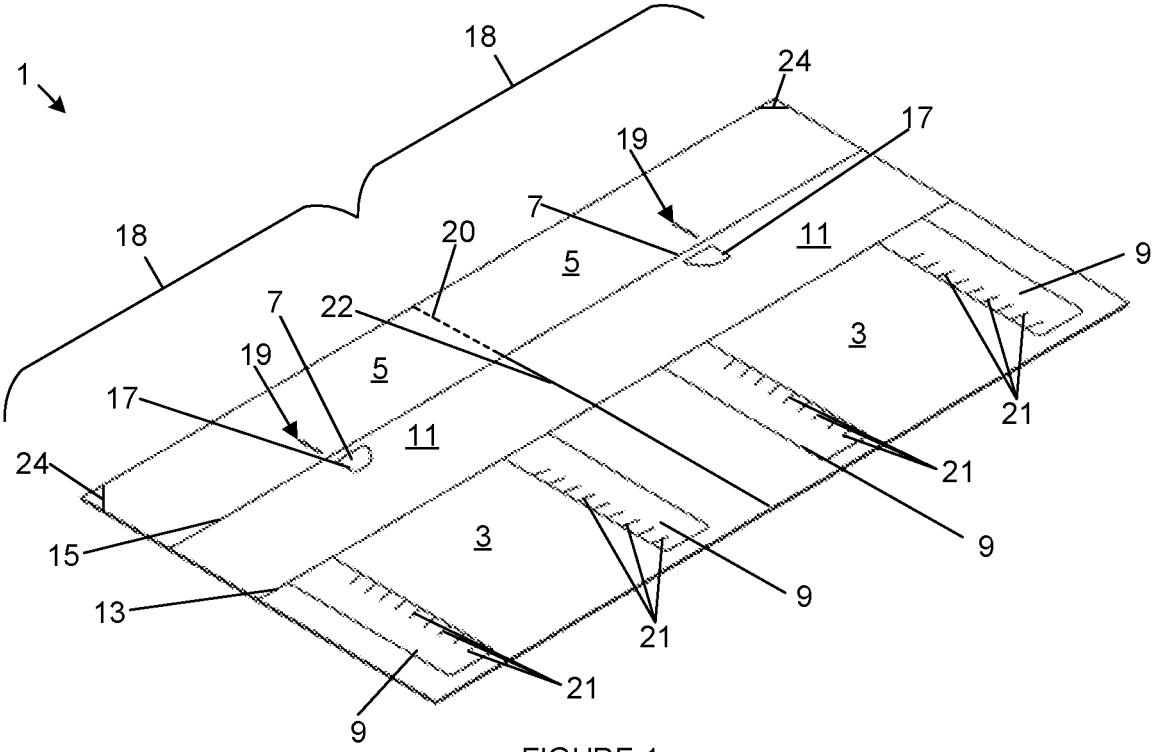
FIG. 1 illustrates a blank that may be folded to form a baffle assembly according to a first exemplary embodiment of the invention.

A baffle assembly is provided which is made or manufactured from stiff planar material such as cardboard, including fluted or corrugated cardboard, or suitable plastics materials, including corrugated polypropylene. The assembly has a base which supports the assembly in an air flow path or on which the assembly rests. It further includes a deflector which extends hingedly from the base. That is to say that the deflector is angularly adjustable relative to the base about a hinge or hinge-like connection or extension. An angle selector is further provided for supporting or securing the deflector at a selected or desired angle relative to the base. The baffle assembly is operable between a collapsed condition and a deployed condition. In the collapsed condition the base, the deflector, and the angle selector are substantially co-planar or lie in a substantially planar configuration. In other words, the baffle assembly has a sheet-like configuration in the collapsed condition. In the deployed condition, the angle selector extends between the base and the deflector to support or secure the deflector at the selected angle or to prevent the deflector from falling onto the base or falling below a minimum angle relative to the base.

The sheet-like configuration of the collapsed condition may facilitate stacking of a plurality of baffle assemblies.

The base may include a plurality of fold sections which form a height adjustment mechanism. The height adjustment mechanism may be configured to increase a height of the base above a surface on which it rests, such as a top of a cargo item in a container, when at least one of the fold sections is in a substantially upright position. In order to configure a minimum height, the fold sections may, for example, be alternately folded on one another in a concertina fashion.

The fold sections may have one or more notches defined at a side of each relevant fold section. The notches are configured such that at in some configurations of the height adjustment mechanism, some of the notches may align. In a stacked configuration (or minimum height configuration), for example, each fold section lies flat on an adjacent fold section allowing at least some of the notches to align to form a channel. At least one of the plurality of fold sections may include a securing tab or catch configured to be wedged into the aligned notches (or the channel formed by the aligned notches) to secure the fold sections in a selected configuration. The wedging of the securing tab into the aligned notches forms a friction fit therewith that resists the relative movement of the fold sections to one another.

The angle selector may have an at least partially arcuate shape or an arcuate edge in plan view in the collapsed condition. It may be formed by a hinged cut-out provided on either the base or the deflector, and the other of which includes a complementary aperture or slot configured to receive the angle selector. The hinged cut-out may thus have an arcuate edge extending from one side of the hinge which intersects a substantially straight edge extending from the opposite side of the hinge.

The angle selector may include a plurality of foldable angle selector tabs. Each angle selector tab may be operable to secure the deflector at the selected angle relative to the base, or at least preventing the deflector from falling below a minimum angle relative to the base, by folding the relevant tab transverse to the complementary shaped aperture. Alternatively, the angle selector may include a plurality of teeth along an arcuate edge. Each of the plurality of teeth may be configured to provide selectable position engagement with the complementary shaped aperture so as to secure or support the deflector at a selected angle relative to the base. The angle selector may therefore be used to prevent the deflector from collapsing towards the base past a selected minimum angle.

The angle selector may be integral with either the base or the deflector. A plurality of angle selectors may be provided, preferably spaced apart along the length of the base or deflector or both.

Where the baffle assembly is provided as a planar blank of material, fold lines, scoring or sulcations may be provided on the blank to facilitate folding of the blank into the baffle assembly. Cut lines may also be provided on the blank to enable removal of complimentary components, such as a covering unit, instructional panels, and the like therefrom.

The baffle assembly may include at least one covering unit, or cover, having an opening for mounting each covering unit onto a corresponding angle selector to at least partially cover a void formed the by the cut-out of the relevant angle selector. Where the angle selector is provided as a hinged cut-out, a void is formed in the base or the deflector, as the case may be, which may at least partially defeat the purpose of the baffle by allowing airflow through the void. By covering the void with a covering unit air flow through the void may be avoided or at least reduced.

Either one or both of the base and the deflector may be sized to permit it to extend substantially across the width of a standard storage container, preferably a refrigeration container or reefer. Such storage containers are typically standardised, particularly in their width, making standardisation of the baffle length straightforward.

The baffle assembly may include at least one anchor member which allows it to be secured, stabilised and supported on an item in the storage container on which it is installed. Preventing the baffle from moving from its installed position during transport may be a critical factor. Should a baffle move from its installed position, it may not only reduce its efficacy, but may in some scenarios move to such an extent as to obstruct the refrigeration equipment (which would likely cause an entire shipment of perishable products to become spoilt). The anchor member or members may be cut from the base and may be at least partially releasable therefrom so that it may be tucked behind a strap associated with the item. Such straps are typically used in containers to secure loads in place and prevent shifting during transport. Loads or items in the storage container may include pallets and boxes.

The anchor member may include a plurality of securing formations defined by cutlines or slots provided on it which allow a strap, when urged against at least one of the plurality of securing formations, to offset these and engage the anchor member so as to hold the anchor member in place. The cutlines may extend partially across the width of the anchor member and at an angle thereto.

The baffle assembly may include a plurality of assembly units that are at least partially connected to one another. The assembly units may be identical units or mirror images of each other. Each assembly unit may be at least partially connected to adjacent assembly unit by a frangible connection which may be formed by a line of perforations or a line of weakness. Each of the assembly units may be foldable onto adjacent assembly units.

The deflector may have a substantially rectangular shape. At least one free corner of the deflector may be provided with a chamfer or a fillet. Alternatively, the free corner may be provided with a line of weakness or a perforated line for removing a section of the corner to form a chamfer or a fillet or provided with a fold to form a chamfer or a fillet at the free corner. This may enable the deflector to be installed even in the presence of obstructions along the upper corners of a container, such as mounting brackets, welds, and the like.

A baffle blank of stiff, sheet material is also provided. The blank may have suitable fold lines, cut lines, perforations or sulcations arranged to form or define a base, a deflector extending from the base along a hinge line, and an angle selector formed as cut-out in the baffle blank. The blank may be folded into a deployed condition in which it forms a baffle assembly in which the deflector is supported at a selected angle relative to the base by the angle selector with the angle selector extending between the base and deflector. The blank may also include a plurality of complimentary components to be used with the baffle assembly once it is in the deployed condition. The complimentary units may be used to improve performance of the baffle assembly or to provide instructions on how to use the baffle assembly.

The base, the deflector, the angle selector and anchor members may be integral with each other, or put differently, formed from the same sheet of material. They could alternatively be formed from separate sheets of material which are secured together, for example using adhesive, staples or the like. The angle selector may be formed as a hinged cut-out in either the base or the deflector or as a "pop-out" component thereon.

A method of deploying a baffle assembly in a storage container is also provided. Where, in its simplest form, the baffle assembly includes a base which may support the assembly in an air flow path in a container, and a deflector hingedly extending from the base. The method may include the steps of placing the baffle assembly on an item on which the assembly is intended to be installed. The deflector may be folded about its hinge connection with the base to a selected angle relative to the base so that the deflector at least partially obstructs an airflow path atop the item on which it is installed. The air flow in which the deflector is placed may provide a sufficient force to keep the deflector at a sufficient angle relative the base to obstruct the air flow as desired, or may cause the deflector to be urged to such an angle once the air flow is created.

Alternatively the baffle assembly may include an angle selector arranged for supporting the deflector at a selected angle, or at least preventing that the deflector collapses past a selected minimum angle, relative to the base. The method may then include an extra step of folding the angle selector into an upright position and using the angle selector to support the deflector at the selected angle relative to the base with the angle selector extending between the base and the deflector.

In a further step, the deflector may be folded so that the angle selector extends from the either the base or the deflector partially through a complementary aperture provided in the other of the base or deflector. Thus the aperture may be shaped to receive the tip or a more substantial part of the angle selector.

The angle selector may be at least partially arcuate or have an at least partially arcuate surface, and may include a plurality of foldable angle selector tabs. Each angle selector tab may be operable to secure the deflector at the selected angle relative to the base. There is thus provided for the step of securing the deflector at a selected angle relative to the base to include folding the angle selector tab transverse the complementary shaped aperture when the angle selector at least partially extends therethrough, resulting in securing of the deflector at the angle relative to the base. The angle of the crease along which the angle selector tab is folded may be at an acute angle relative to the radius extending from the hinge connection of the deflector to the arcuate edge of the angle selector such that once the angle selector tab has been folded more than 90° from its original position in the plane of the angle selector, the abutting deflector will need to be lifted off of it to allow it to return to its original position. Alternatively the angle selector may simply be provided as an angle maintaining member having an at least partially arcuate shape and configured to prevent the deflector from collapsing past a minimum effective angle relative to the base by abutting against the deflector in use.

The method may be performed so that the baffle assembly is installed at an operatively upper region of items in a storage container so as to at least partially block an air flow path along a top of the container.

The baffle assembly may at least partially block an undesired air flow path in a storage container so as to alter the normal airflow and improve airflow through cargo items in the container, thereby at least partially improving cooling of the items and their contents. The baffle assembly may be provided in the form of a foldable blank of stiff material having a generally planar shape that is foldable from a collapsed condition into a deployed condition. The baffle assembly may be installed by placing the deployed baffle assembly adjacent or atop an item, such as a pallet, crate, box or the like, in a storage container, and may be secured to items in the container by anchor members forming part thereof. The storage container may be a refrigeration container.

The extent to which the baffle assembly interferes with the air flow may be proportional to the extent to which it blocks the air flow path. The angle at which the deflector extends from the base, and therefore the extent to which it extends into and block the air flow path, may be manually adjustable by securing the deflector with at least one angle selector which is operable to secure the deflector at one of a plurality of selectable angles.

The baffle assembly described herein may be versatile and may find broad application for example in storage containers, and particularly refrigerated containers or in refrigerated storage rooms. As a result, the term "storage container" should be interpreted to include any such item or environment, and also similar items or environments which may require the use of such a baffle assembly to manipulate air flow therein.

As described above, air may follow an undesired air flow path in a storage container due to gaps between items located within the container, including a gap along the roof of the container where items are not stacked all the way to the roof.

FIGS. 1 to 7 illustrate a first exemplary embodiment of the invention.

FIG. 1 shows an exemplary embodiment of a baffle blank (1) which may be folded into a baffle assembly (100) according to an embodiment of the invention. Items and features that will form part of the baffle assembly (100) are visible in the blank (1), including a base (3), a deflector (5), angle selectors (7) and anchor members (9). The deflector (5) may extend from the base (3) along a hinge line (15). In the present embodiment the base (3) includes a foldable section (11) such that, in use, the deflector (5) provides a baffle or air-interference member.

The blank (1) may be manufactured from corrugated cardboard material or a similar form of material and the direction of the fluting thereof is selected to allow fold lines to be easily formed in certain desirable positions, and to resist folding of the baffle assembly (100) in sections that may endure mechanical stresses in use. The aforementioned fold lines are provided on the blank (1) to facilitate folding thereof into the baffle assembly (100). Due to the blank (1) being provided in a planar sheet of stiff material, the base (3) and deflector (5) may be provided in the blank (1) in a substantially planar arrangement. It should be appreciated that the material should be of a stiff material capable of withstanding air flow forces, such as the force with which the air flow in the container would impact the baffle assembly, however, the material should still be of sufficient pliability to allow adjustment of the baffle assembly without damaging the baffle assembly.

A first fold line (13) forms the boundary between the base (3) and the foldable section (11) of the base (3), while a second fold, or hinge, line (15) forms the boundary between the foldable section (11) and the deflector (5).

The angle selectors (7) are provided in the foldable section (11) and connected thereto at a straight fold line (17). The remainder of the boundary of the angle selectors (7) are cut loose from the foldable section (11) and free ends of the angle selectors therefore effectively hinge about the fold line (17). In some embodiments, these free ends may initially be connected to the foldable section (11) with frangible connections, such as perforated lines or break-away tabs. In this embodiment, a user would have to apply force to the free ends of the angle selectors (7) to release and fold them along the fold line before a first use. A complementary shaped aperture (19) is provided in the deflector (5) for each of the angle selectors (7). Its operation is further explained below.

Each anchor member (9) is provided in, and is connected to the base (3) at the first fold line (13), with the remainder of its boundary being cut loose therefrom or frangibly connected thereto. The anchor members (9) extend lengthwise partially across the width of the base (3). Each anchor member (9) also includes a plurality of cutlines (21) spaced along its length and extending from a side thereof at least partially across its width. The cutlines (21) are cut into the blank (1) to allow release of the anchor members (9) from the base. The operation of the cutlines (21) is also explained further below.

In one embodiment, the baffle blank (1) includes two identical (but mirror image) assembly units (18) that are positioned side-by-side. The assembly units (18) are frangibly connected to one another at the deflectors (5) along a line of perforations (20) that lies in a line of symmetry between the two assembly units. At the boundary between the deflectors (5) and the foldable sections (11) the line of perforations (20) extends into a cutline (22) that cleanly separates the foldable sections (11) and the bases (3) of the respective assembly units (18). The assembly units are foldable along the line of perforations (20) and cutline (22) to allow the one assembly unit to be folded onto the other.

The outer free corners of the deflectors (5) on each of the assembly units (18) are provided with a fold line (24). This allows a piece of material at the free corners of the deflectors (5) to be folded over, allowing the corner to form a chamfer. This may provide a better fit when the baffle blank (1) is deployed in a container having chamfered or rounded corners or, for example, when a container has weld seams in its interior.

Figure 2:
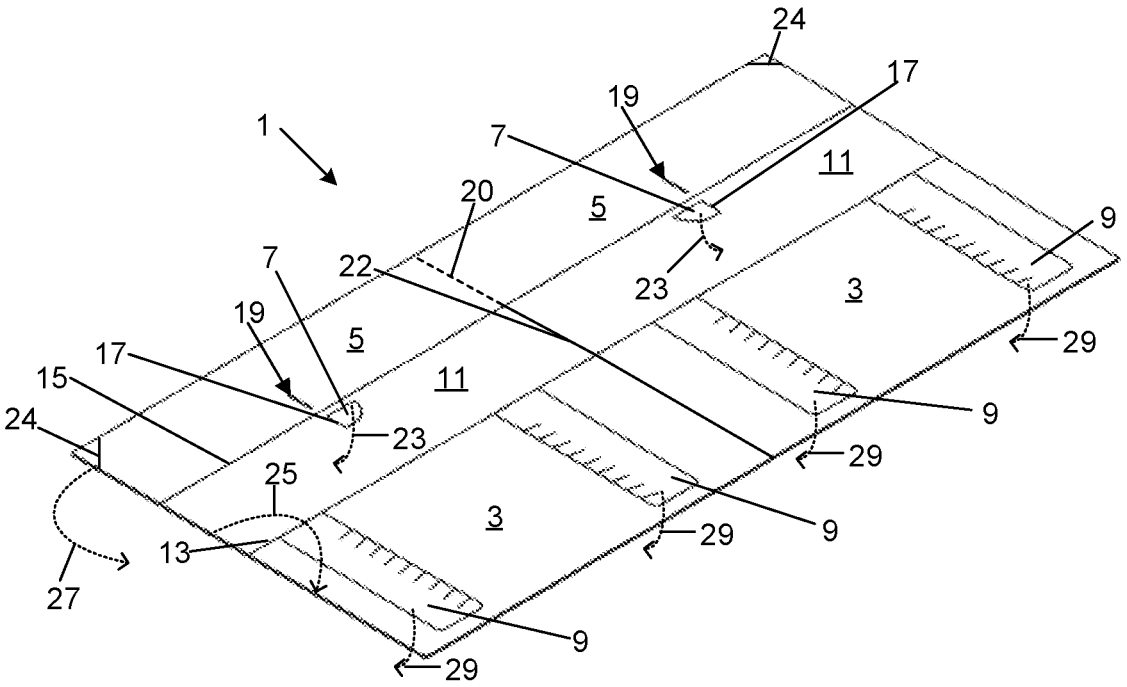
FIG. 2 illustrates how to fold the blank of FIG. 1 into the baffle assembly.

FIG. 2 shows an example illustration of how to fold the blank (1) of FIG. 1 into a baffle assembly (100) of the present invention. Like features and components are indicated by like numerals.

First, the angle selectors (7) may be folded along their straight fold lines (17) from a hidden condition, wherein each angle selector (7) lies substantially flush with the base (3) downwardly as seen by an observer of the representation, in the direction of a first set of directional arrows (23) shown and away from the observer of the representation until they project from the foldable section (11) substantially perpendicular thereto. Then, the foldable base section (11) may be folded onto the base (3), as shown by a directional arrow (25), along the first fold line (13). The deflector (5) will then lie substantially flat against the base (3) and may then be folded away therefrom and along the second fold line (15), in the direction shown by a directional arrow (27). As the deflector (5) is folded away from the base (3), the angle selectors (7) will need to project through the slots (19) in the deflector (5) to allow such folding.

Finally, the anchor members (9) may be folded away from the base (3) and away from the observer of FIG. 2 along the first fold line (13), where they are connected to the base (3), in the direction as shown by directional arrows (29).

Figure 3:
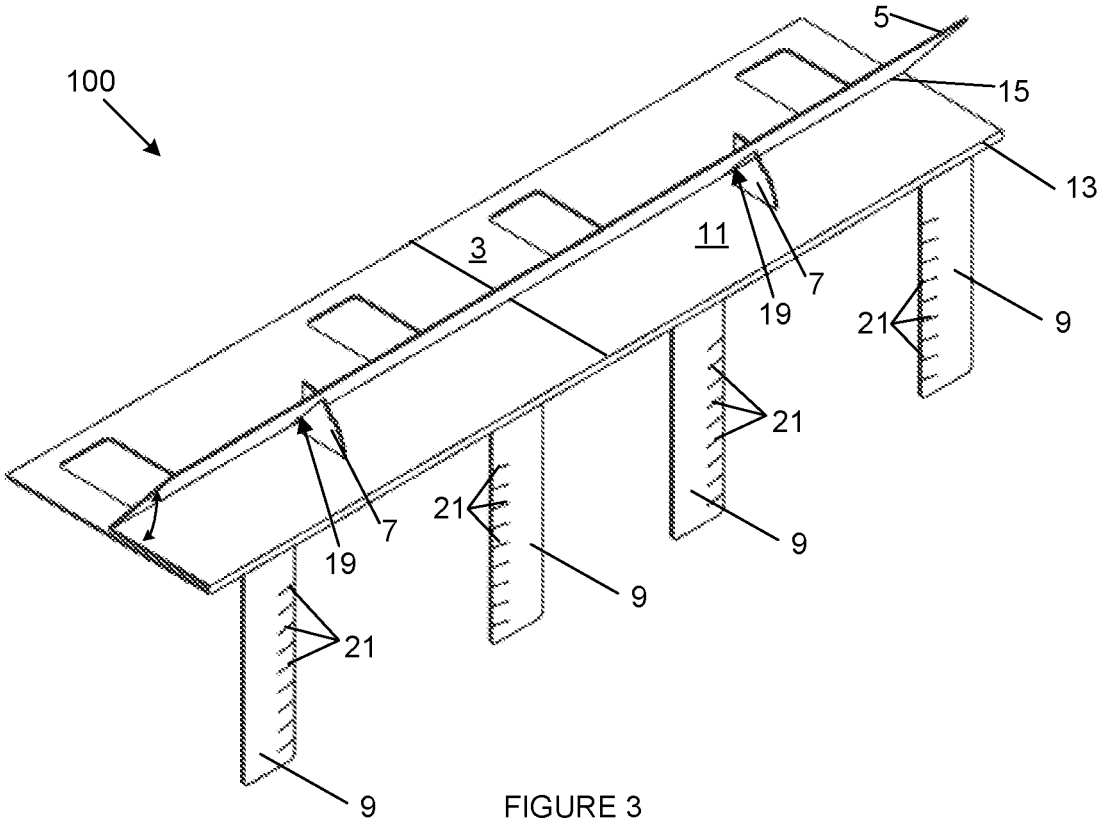
FIG. 3 is a three-dimensional view showing a front of the blank of FIG. 1 folded into a deployed baffle assembly in accordance with the first embodiment of the invention.
Figure 4:
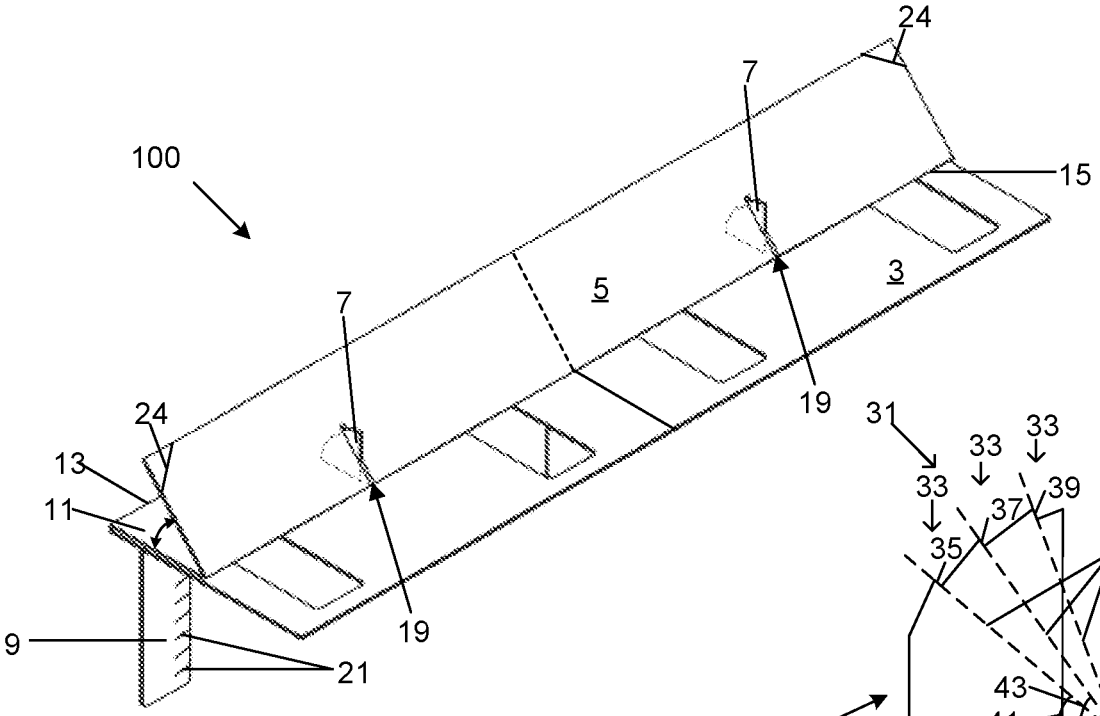
FIG. 4 is a three-dimensional view of the baffle assembly of FIG. 3 and showing its rear.

FIGS. 3 and 4 show the blank (1) after the folding described above with reference to FIG. 2, when it has been formed into a deployed baffle assembly (100) according to the invention. Like reference numerals between FIGS. 1 and 3 are used to indicate like features and components.

The angle selectors (7) extend through the slots (19) provided in the deflector (5). The foldable section (11) lies relatively flat against the base (3), however it should be noted that the foldable section (11) may slightly be lifted due to its own bias. The second fold line (15), which connects the deflector (5) to the foldable section (11), may fold the section (11) towards the base (3) and may also slightly be lifted due to its own bias. As a result, the deflector (5) may be considered to extend from the base (3) in the condition shown. The angle at which the deflector (5) extends from the base (3) is determined by the angle at which the angle selectors (7) hold the deflector (5). Alternatively the foldable section (11) may also be lifted by placing an item, such as a stop or a wedge, between the section (11) and the base (3) so as to form a height adjustment mechanism which can be used to adjust the height of the deflector (5) when the baffle assembly (100) is in the deployed condition.

The anchor members (9) project from the base (3) and their operation is explained further below.

Figure 5:
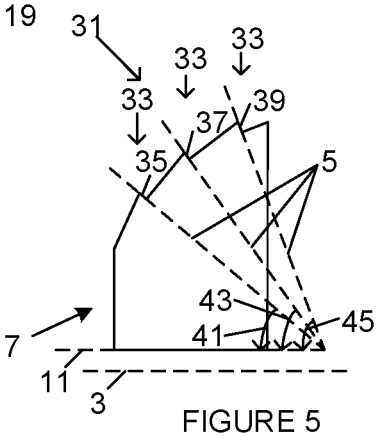
FIG. 5 is a side view showing an angle selector according to the first embodiment of the invention.

FIG. 5 shows an enlarged side view of the angle selector (7) and illustrates its operation. Each angle selector (7) of the present embodiment is at least partially arc- or wedged-shaped in side profile. When in the upright position, shown in FIGS. 3 and 4, the angle selectors (7) may be considered to be in an operating position wherein they extend substantially perpendicularly from the base (3). Although they are, at least in the present embodiment, cut from the foldable section (11), they may be considered to angle the deflector (5) from the base as the foldable section (11) is an extension of the base (3).

The radius of the arc includes a holding surface(s) (31) which, in the deployed condition shown in FIGS. 3 and 4, lies substantially perpendicular to the deflector (5). The holding surface (31) of the present embodiment is toothed and includes a plurality of teeth (33). Between each set of adjacent teeth, a shoulder (35, 37, 39) is formed. The shoulders (35, 37, 39) serve as a hold formation. Three shoulders are provided by the present embodiment. The deflector (5) may rest on any one of the three shoulders (35, 37, 39) formed in the angle selector (7). The end of the apertures (19) furthest from the second fold line (15) will rest on a shoulder (35, 37, 39). Two substantially identical angle selectors (7) and complementary shaped apertures (19) form part of the present embodiment. A user may place the deflector (5) on a shoulder (35, 37, 39) to allow the deflector to extend from the base (3) at a desired angle. Presently, with the three shoulders (35, 37, 39), a user may select any of the three shoulders to achieve any of three different angles (41, 43, 45). It will be apparent that the highest of the shoulders (39) will result in the largest angle (45) between the deflector (5) and the base (3), while the lowest shoulder (35) will result in the smallest angle (41) therewith. The intermediate shoulder (37) will result in an intermediate angle (43). The shoulders each correspond to a different angle at which a user may set the deflector (5) to protrude from the base (3), and also to retain the deflector at that corresponding angle.

It should be noted that as the angle selectors (7) of the present embodiment are identical, and the deflector (5) is substantially planar, the same shoulder will be used on each of the angle selectors (7) to ensure the deflector is retained at the desired angle relative to the base (3) corresponding to the shoulder used.

It should be appreciated that in an alternative embodiment the angle selectors (7) may be provided on the deflector (5) and the complementary shaped apertures (19) on the base (3). The purpose of the angle selectors (7) would remain the same and, in such an embodiment, the selected shoulder (35, 37, 39) would urge against the corresponding aperture (19) in the base (3) so as to operatively secure the deflector (5) at the selected angle relative to the base.

Figure 6:
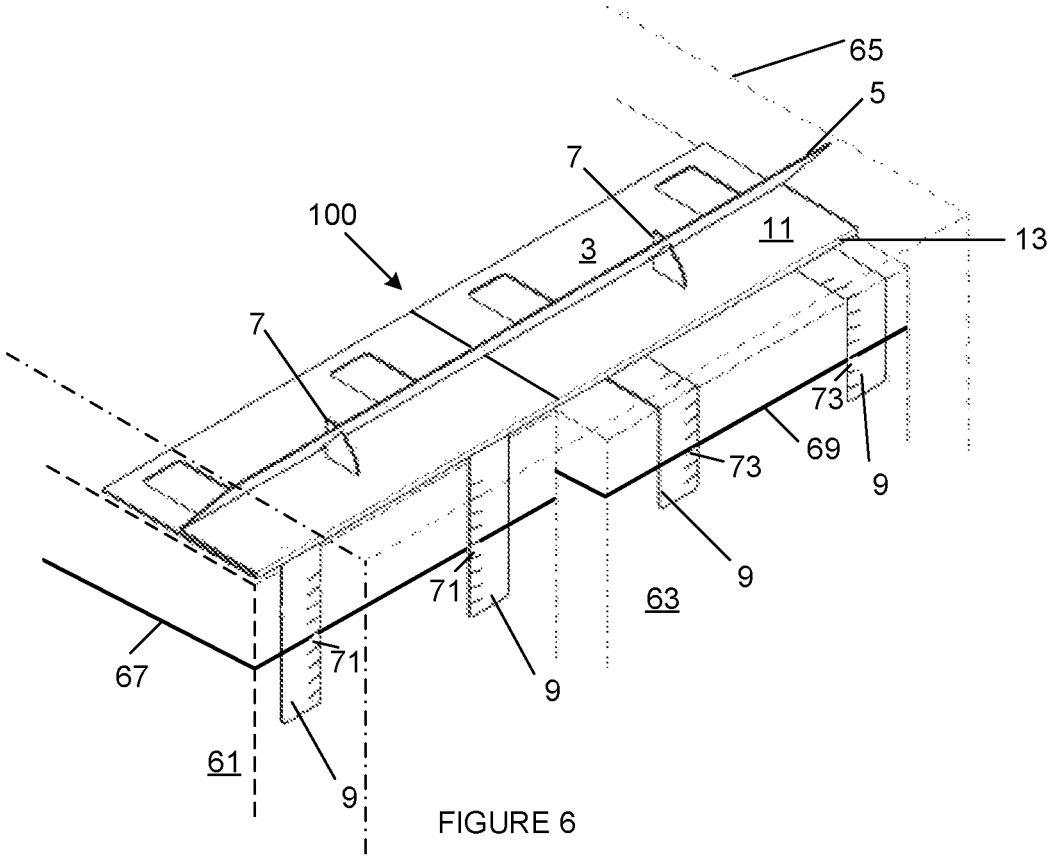
FIG. 6 is a three-dimensional view of the baffle assembly of FIGS. 3 and 4 in use.
Figure 7:
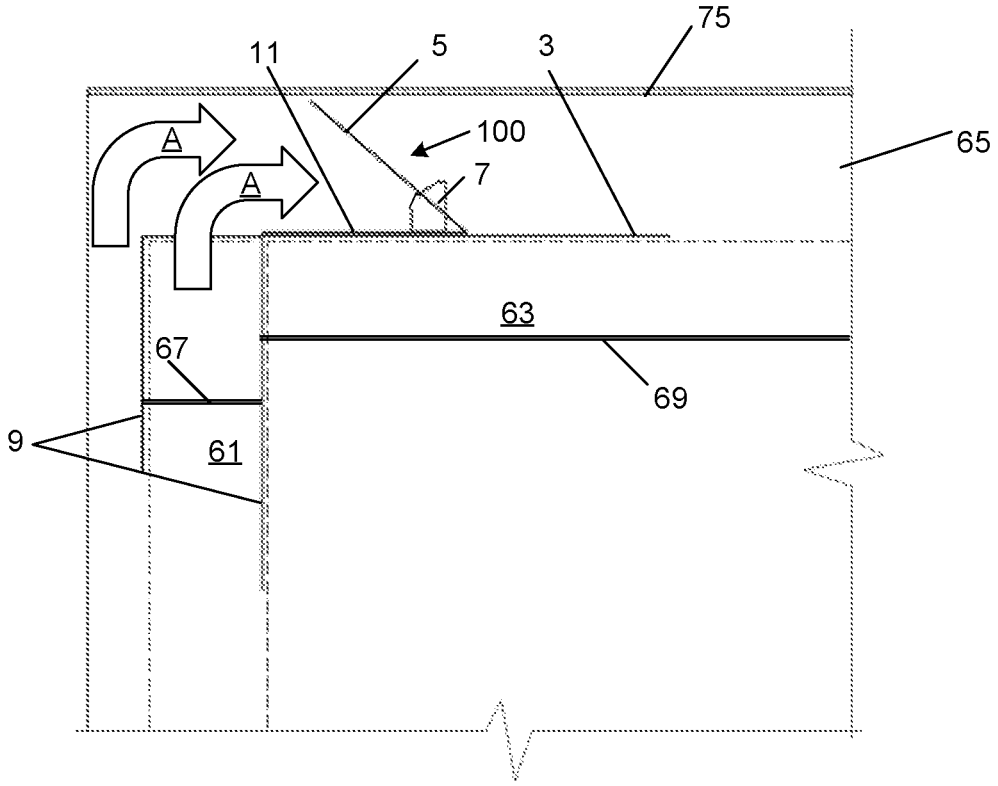
FIG. 7 is a side view of the baffle assembly of FIG. 6 in use.
Figure 8:
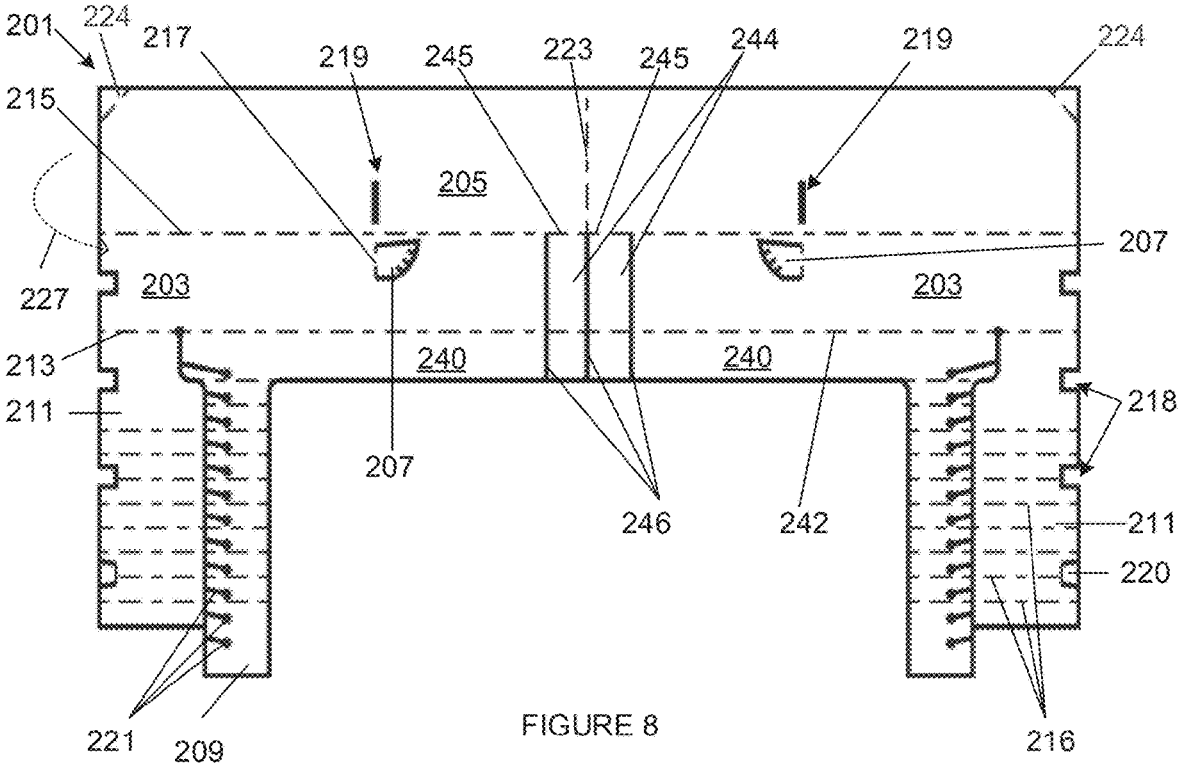
FIG. 8 illustrates a blank that may be folded to form a baffle assembly according to a second exemplary embodiment of the invention.

FIGS. 6 and 7 show the baffle assembly (100) of FIGS. 3 to 5 in an installed condition placed on top of cargo items (61, 63), presently boxes, in a refrigerated storage container (65). Like reference numerals again indicate like features and components.

The baffle assembly (100) is supported on its base (3) on top of the items (61, 63). The baffle assembly is of a length that allows it to extend substantially across the width of the container (65) and across the two items (61, 63), with about half of the baffle assembly (100) supported on each of the items (61, 63). Two anchor members (9) are located against each of the items (61, 63) by tucking the anchor members behind strapping (67, 69) secured around the items, as described in more detail below. An air flow path, which may normally be expected to be followed by air circulating within the container without the baffle assembly being installed therein, is shown by directional arrows (A).

The items (61, 63) in the container are located towards a rear thereof, near its doors. Due to different sizes of items that may be stored in a container, the two items may not be aligned where the baffle is installed. In the embodiment shown, one item (61) is located further forwards and therefore further away from the rear of the container than the other item (63). The length of the anchor members (9) allow the baffle assembly (100) to still be adequately secured despite the items (61, 63) not being aligned.

The first fold line (13) of the baffle assembly (100) is located along a rear-most and upper-most edge of the item (61) located more towards the front of the container. As previously discussed, the anchor members (9) are connected to the base (3) at this fold line and the orientation of the baffle assembly (100) along the edge of the first item (61) allows the anchor members (9) on top of the first item (61) to extend downwards along the rear-most side of the first item (61). The length of the anchor members (9) are sufficient to allow the two anchor members (9) at the second item (63) to first extend backwards along the top of the item (63), and then bend around its rearmost and uppermost edge to then extend downwards along its rear-most side.

As is known in the art, strapping (67, 69) is secured around the items (61, 63) to bind it closed. The anchor members (9) of the baffle assembly (100) may be tucked behind the strapping to secure the baffle assembly in position. Any one of the plurality of outlines (21) along the length of the anchor members (9) may substantially align with the strapping (67, 69). The anchor members (9) will generally extend substantially directly downward along the rear-most side of the items (61, 63), and strapping will generally be parallel to the width of the items (61, 63). As a result, the cutline, which lie at an angle to the width of the anchor members (9), also lie at an angle to the strapping (67, 69). The anchor member (9) may therefore be bent at the cutline nearest the strapping and the portions (71, 73) of the anchor member adjacent the cutline may be hooked around the strapping. This effectively anchors the anchor members to the strapping (67, 69), further securing the baffle assembly (100) in its installed position.

In the installed condition shown in FIGS. 6 and 7, the baffle assembly (100) rests on its base (3) and is located at least partially in an air flow path (A) inside the storage container (65) and between the top of the items (61, 63) and a roof (75) thereof. The base (3) is located on top of the items (61, 63) and supports the baffle assembly (100) in the air flow path. The deflector (5) extends from the base (3) at an angle thereto and serves to interfere with the air flow path (A), thereby preventing the normal flow of air which is often undesired in the container. It should be noted that the deflector (5) extends transversely into the air flow path (A). It will be apparent that the extent to which the deflector (5) protrudes into the air flow path (A) will influence the extent of its impact on the air flow in the container. The user may select an angle based on the desired extend to which the air flow should be influenced. If the entire gap above the items (61, 63) in the container and the roof (75) is to be closed, the angle may be selected to be such that the deflector (5) extends up to the roof, thereby serving to close substantially the entire gap at the top of the container. In the present embodiment, the blank (1) is manufactured from corrugated cardboard material and is slightly flexible. This may allow the deflector (5) to be jammed into the gap between the top of the items (61, 63) and the roof, thereby completely closing the gap.

The baffle assembly (100) may be placed at an operatively upper region of the storage container (65) to block the flow of air along the top of the container, but may also be placed at other locations as required.

With the deflector (5) extending at an angle from the base (3), it may be considered to be in its deployed condition. Should it for some reason be required that the baffle assembly (100) allows the normal air flow and not interfere therewith, it may be converted to a collapsed condition wherein the deflector (5) is not supported by the angle selectors (7), such that it lies substantially flat against the base (3) and/or foldable section (11). However, the deflector (5) may have a tendency to sit at a slight angle from the base (3) and/or foldable section (11) which may facilitate lifting of the deflector by the pressure of the flowing air. In certain operating conditions it may be desirable to remove the baffle assembly (100) from the flow path when it is not needed.

FIGS. 8 to 14 illustrate a second exemplary embodiment of a baffle assembly (200) and a blank (201) therefor. Like reference numerals used in the description of FIGS. 1 to 7 are used to indicate like features and components of the embodiment shown in FIGS. 8-14.

Items and features that will form part of the baffle assembly (200) are visible in the blank (201), including a base (203), a deflector (205), angle selectors (207) and anchor members (209).

Figure 10:
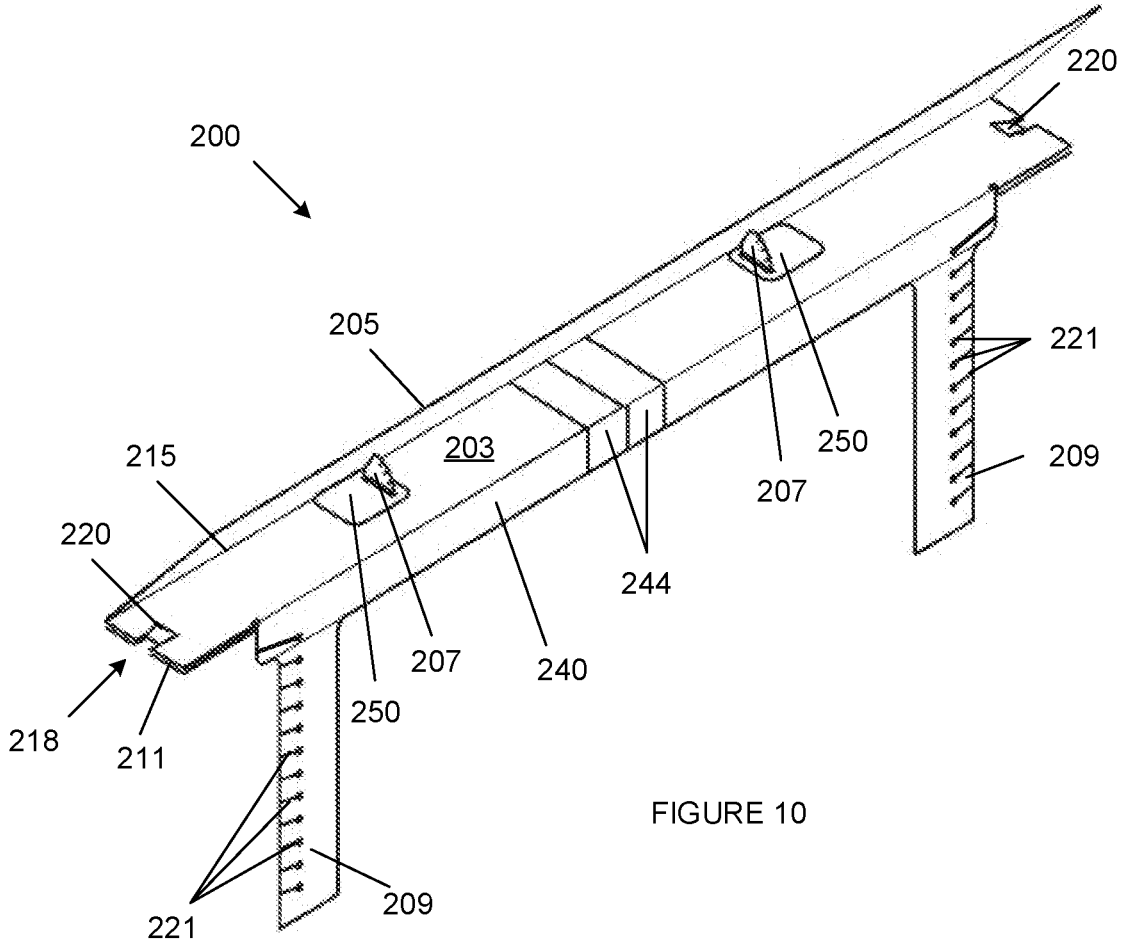
FIG. 10 is a three-dimensional view showing a front of the blank of FIG. 8 folded into a deployed baffle assembly with fold sections in a stacked configuration in accordance with the second embodiment of the invention.
Figure 11:
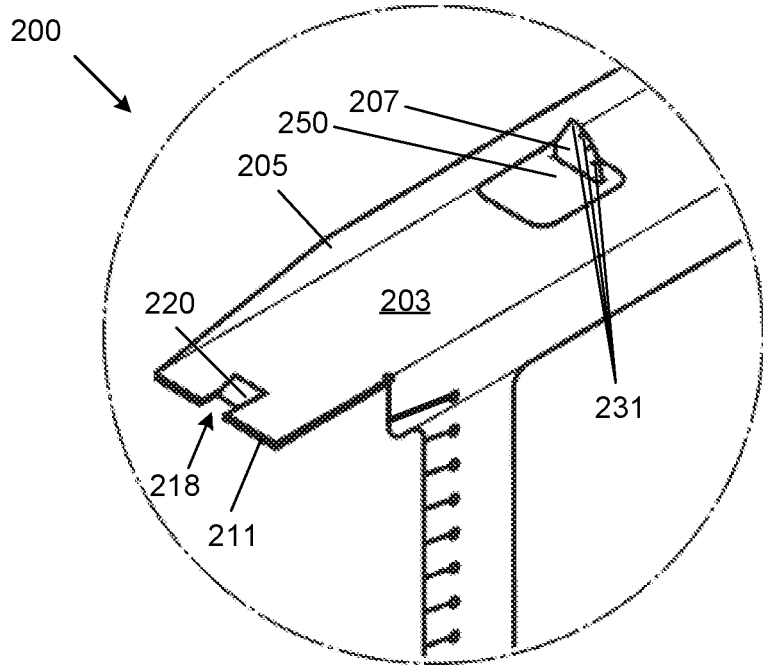
FIG. 11 is an elevation of the fold sections in the stacked configuration of FIG. 10.
Figure 12:
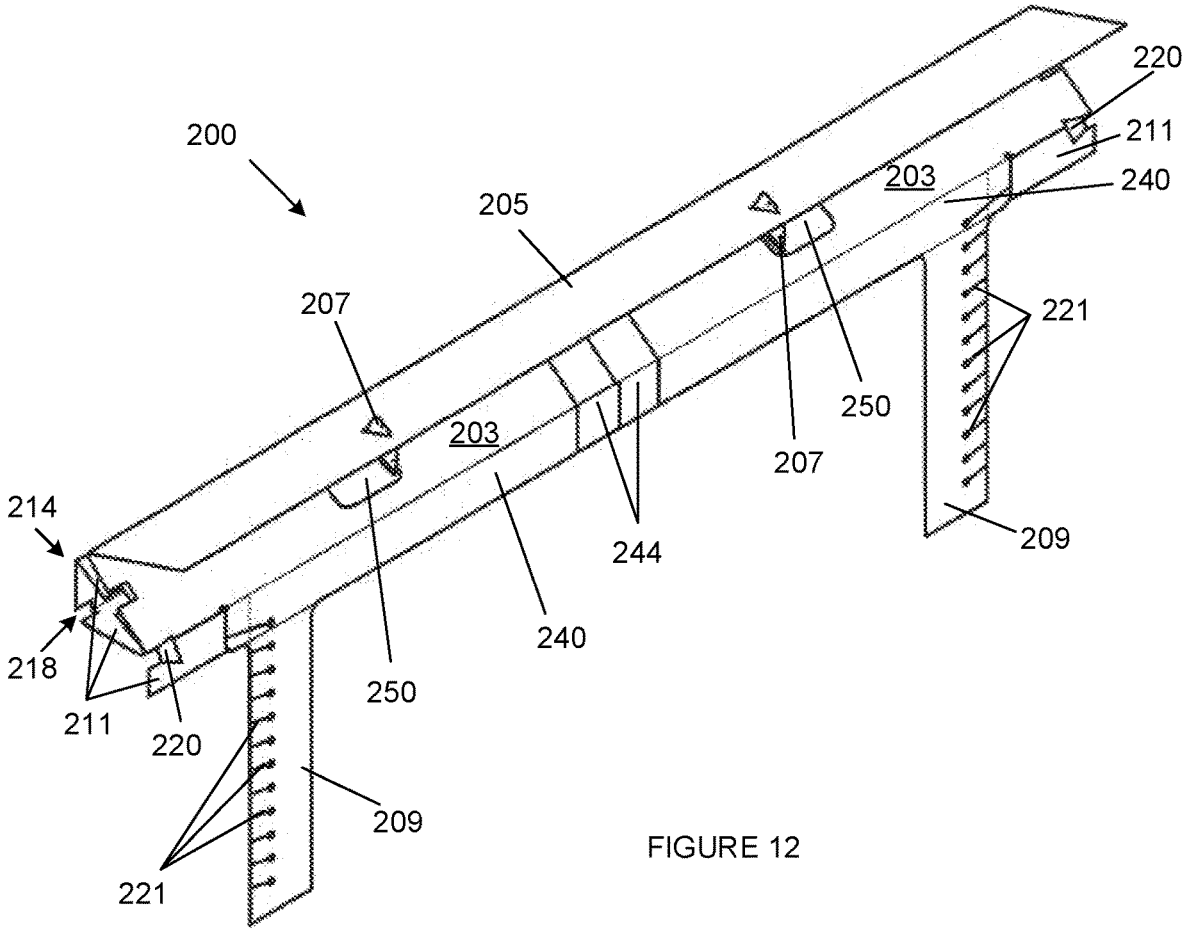
FIG. 12 is a three-dimensional view showing a front of the blank of FIG. 8 folded into a deployed baffle assembly with fold sections in a selected configuration in accordance with the second embodiment of the invention.
Figure 13:
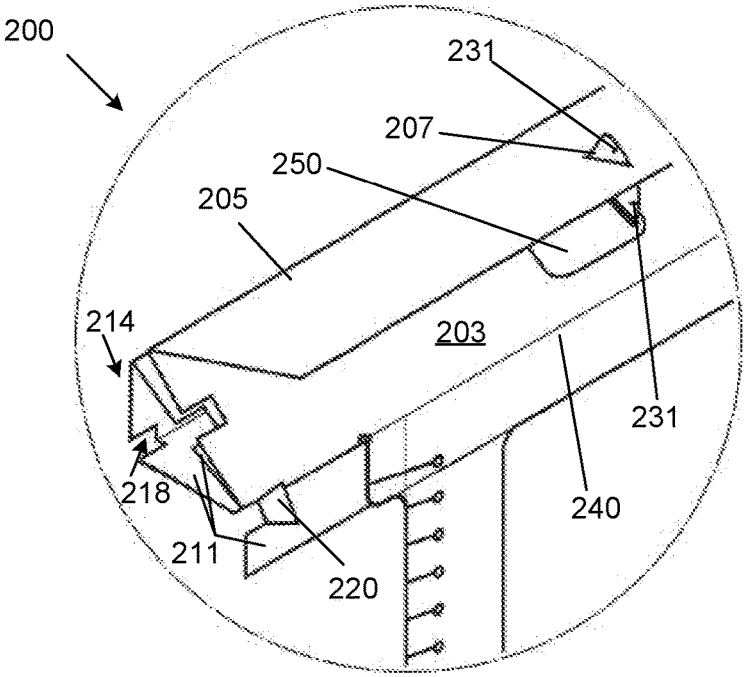
FIG. 13 is an elevation of the fold section in the selected configuration of FIG. 12.
Figure 14:
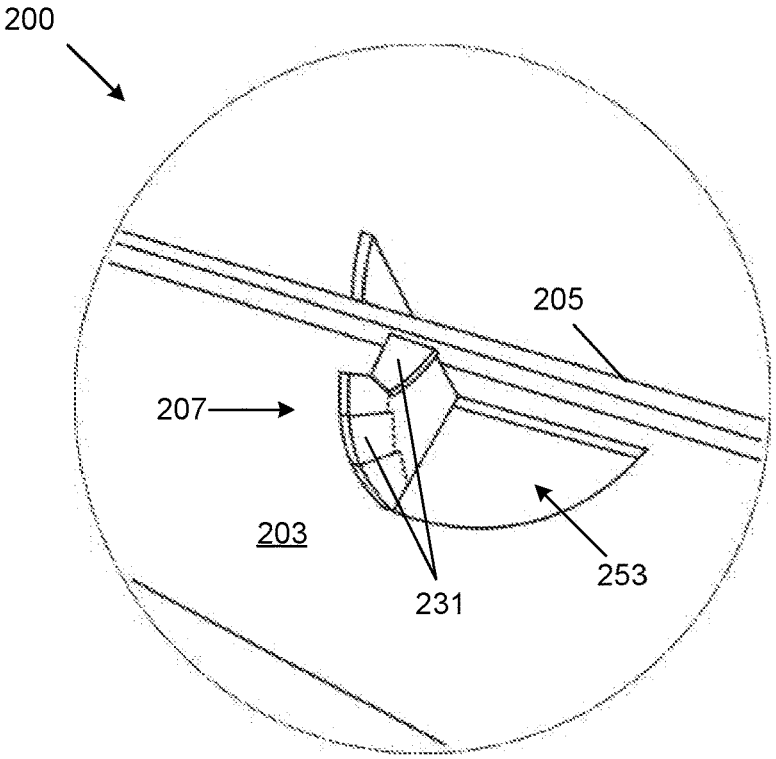
FIG. 14 is an elevation of an angle selector of FIG. 12 in use.

In this embodiment the base (205) includes a plurality of fold sections (211) connected thereto at fold lines (213) and which together form a height adjustment mechanism (214) shown in FIGS. 12 and 13. The height adjustment mechanism (214) may be configured to increase the height of the base, and therefore the height of the deflector (205), by folding the fold sections (211) along corresponding folding lines (216) defined on the fold sections (211). As illustrated in FIGS. 12 and 13 at least one of the fold sections (211) may be folded along the fold lines (216) and into an upright position so as to form a base (203) having a substantially triangular configuration when viewed from the side. At least one of the fold sections (211) may extend over an upper edge of the cargo item and behind at least an edge of a lip extension (240), explained in more detail below, facilitating securing of the fold sections in the triangular configuration. It should be appreciated that each of the fold sections (211) is foldable relative to an adjacent fold section (211). It should also be appreciated that each of the fold sections (211) may be configured to lie substantially flat on an adjacent fold section (211) when no adjustment of the height is required, as illustrated in FIGS. 10 and 11. FIGS. 10 and 11 show the fold sections (211) in a configuration in which they are alternatingly folded on top of one another in a concertina fashion. Such a configuration may be referred to as a stacked configuration.

At least some of the fold sections (211) include a notch (218) defined at an outer side thereof which is shaped and configured to at least partially receive a securing tab (220) therein. The fold sections (211) are configured such that at least some of the notches (218) may be aligned when the fold sections (211) are folded relative to one another into a selected configuration. By aligning at least some of the notches (218), the securing tab (220) may be used to secure the fold sections (211), when they are folded relative to one another into the selected configuration, by wedging the securing tab (220) into the aligned notches so as to releasably secure the fold sections (211) in the selected configuration. In the present embodiment the securing tab (220) is provided on the fold section (211) which is furthest from a centre of the base (203). It should be appreciated that in an alternative embodiment the securing tab may be provided on any one of the fold sections (211) or that, in an even further alternative embodiment, all of the fold sections (211) may include notches and a releasable securing tab which is configured to secure the fold sections (211) in the selected configuration may be provided separately, for example as an attachment in the blank (201).

In order to achieve the desired purpose, the securing tab (220) needs to be shaped and dimensioned such that at least a portion thereof has a width greater than that of the corresponding notch (218) so as to facilitate securing of the fold sections (211) in the selected configuration. In the present embodiment the securing tab (220) is a trapezium- or truncated triangle-shaped tab enabling the tab to be wedged into the notches (218) thereby facilitating securing of the fold sections (211) in the selected configuration. In an alternative embodiment the securing tab may have another shape wherein at least part of the shape has a width greater than that of the corresponding notches.

Similarly to the embodiment described with reference to FIGS. 1 to 7, the angle selectors (207) are provided in the base (203) and connected thereto at a straight fold line (217). The remainder of the boundary of the angle selectors (207) are defined by cut lines and may be popped out from the base (203) such that free ends of the angle selectors (207) may effectively hinge about the fold line (217). A complementary shaped aperture (219) is also provided in the deflector (205) for each of the angle selectors (207) so as to facilitate securing of the deflector (205) at an angle relative to the base (203) as described in more detail below.

As previously described, as a first step the angle selectors (207) may be cut loose along the cut lines and folded along their respective straight fold lines (217) from a collapsed condition wherein each angle selector (207) lies substantially flush with the base (203) into an upright condition in which they project from the base (203) toward the deflector (205). The deflector (205) may then be folded along the line (215), in the direction shown by a directional arrow (227). Once the deflector (205) has been folded along the fold line (215) as described, the angle selectors (207) may be aligned with the complementary shaped apertures (219) provided in the deflector and urged therethrough. The angle selectors (207) consequently extend through the apertures (219) provided in the deflector (205) as is more clearly shown in FIGS. 12 to 14. The angle at which the deflector (205) extends and is secured to the base (203) is configurable by the angle selectors (207) as explained below.

Each angle selector (207) of the present embodiment is at least partially arc- or wedged-shaped. The angle selector (207) includes a plurality of angle selector tabs (231) provided along an arcuate edge (230) thereof. Each of the angle selector tabs (231) is operable to secure the deflector (205) at the selected angle relative to the base (203) by folding an appropriate tab transverse the complimentary shaped aperture (219) allowing the deflector to abut the tab and preventing the deflector from deviating from the selected angle relative to the base. It should be appreciated that even though only three angle selector tabs (231) are shown, any number of selector tabs may be provided providing an equal number of selection settings.

In an alternative embodiment the angle selectors may be without angle selector tabs, in which case the angle selectors (207) may simply be arranged to support the deflector (205) at an angle relative to the base (203). The angle selectors may further be arranged such that the angle at which the angle selectors support the deflector (205) is a minimum angle of the deflector relative to the base (203) which would enable manipulating of air flow. In other words the angle selectors (207) may be arranged to prevent collapsing of the deflector (205) onto the base (203) when airflow incident the deflector is not sufficient to urge the deflector about the hinge and away from the base (203).

Figure 15:
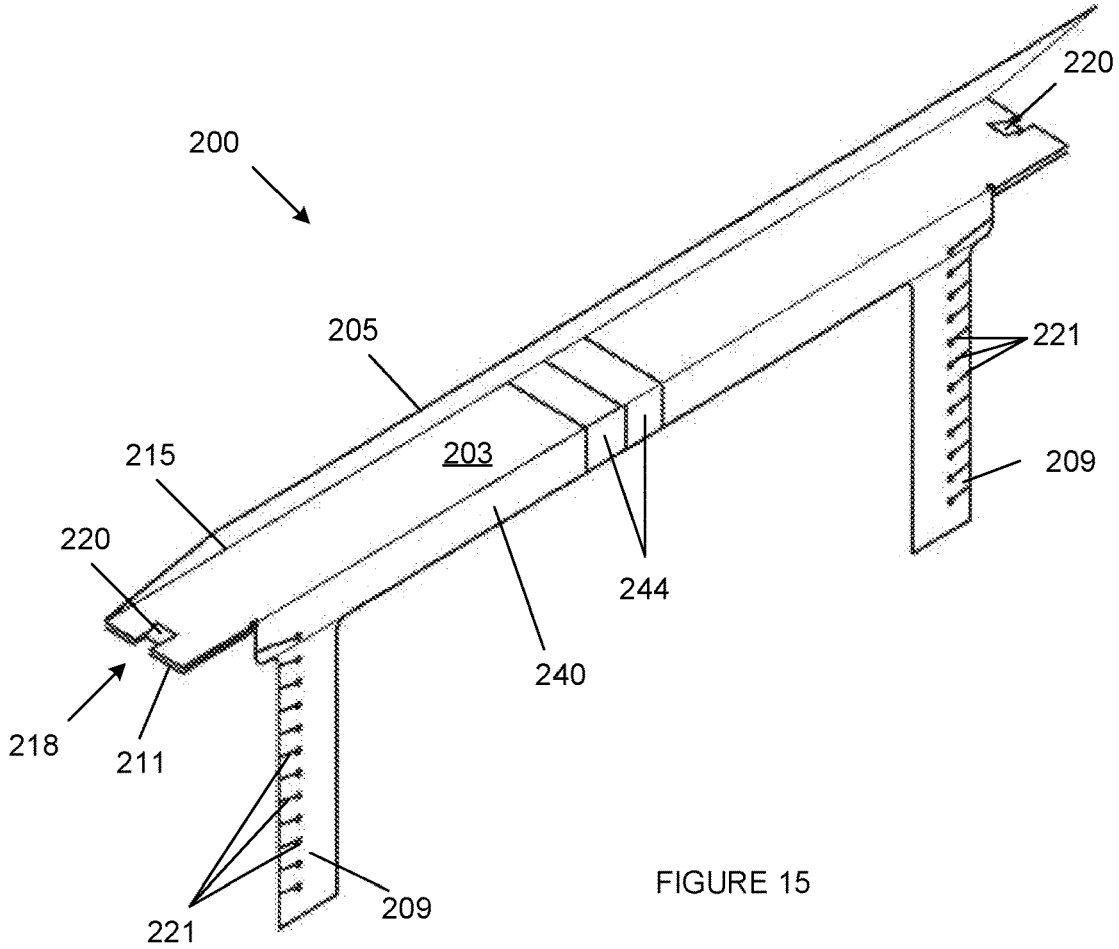
FIG. 15 is a three-dimensional view illustrating an alternative embodiment of the baffle assembly of FIG. 10 excluding angle selectors.

In an even further embodiment the baffle assembly may be provided without angle selectors (207) as shown in FIG. 15. In such an embodiment the deflector (205) may be folded to an angle relative to the base (203) and effectively held at the selected angle by means of incident air flow which urges the deflector towards the selected angle relative to the base.

It should be noted that as the angle selectors (207) of the present embodiment are identical, and the deflector (205) is substantially planar, the same angle selector tab (231) on each of the angle selectors (207) should be used to ensure the deflector is retained at the desired angle relative to the base (203). However, in an embodiment in which the deflector (205) is split along a cut line (223), shown in FIGS. 8 and 9, the angle selectors (207) may be differently configured since the split may facilitate independent movement of the split parts of the deflector (205). The height adjustment mechanism (240) may also be used to facilitate installation of the baffle assembly (200) on cargo items having different heights and therefore, if the deflector (205) is split the angle selectors (207) need not be identical.

After the aforementioned configuration steps have been completed, the blank is in the deployed condition.

In order to facilitate securing of the baffle assembly (200) to a cargo item in use, the baffle assembly is provided with a plurality of anchor members (209) having a plurality of outlines (221) spaced along its length and extending from a side thereof at least partially across its width. The anchor members (209) are substantially similar to the anchor members described with reference to the first exemplary embodiment and for the sake of brevity the functions and features of the anchor members will not be described in detail with reference to the second exemplary embodiment. The anchor members (209) in the present embodiment are in foldable engagement with the base (203) with the remainder of its boundary being cut loose therefrom or frangibly connected to the blank. It should be appreciated that in an alternative embodiment the anchor members may, for example, be provided on a rear end of the base, on the sides thereof or as separate attachments.

In addition to the anchor members (209), the base may include a lip extension (240) configured to enable securing of the baffle assembly to the cargo item. The lip extension (240) is configured to fold along a fold line (242) so as to extend over an upper edge of the cargo item on which the baffle assembly (200) is installed thereby facilitating securing of the baffle assembly to the item.

The lip extension may be divided into a left lip extension and a right lip extension by a cut line extending through a centre thereof.

The baffle assembly (200) may also include includes two or more base sections at least partially separated from each other at intervals along a width of the base. This may enable the two or more base sections to be at least partially moveable relative to one another so as to be placed on surfaces having differing heights. The two base portions may be split by independent panels, such as offset flaps (244), that are hingedly connected to a bottom of the deflector (205) along a fold line (245) at an attached end thereof. The remaining sides and free ends of the offset flaps (244) may be defined by cut lines (246) which split the offset flaps (244) into independent panels and enables easy release of the flaps (244) from the base. The cut lines which separates the panels may allow the base to sit securely atop two surfaces of different heights, be they equal in width or of different widths, with the lip of the base supported above the lower of the two surfaces by the height adjustment mechanism. The offset flaps (244) may provide the advantage of increasing the pliability of the baffle assembly (200) and thereby enable installation of the baffle assembly, with the support of a height adjustment mechanism (214), on items having different heights or curves without tearing or damaging the baffle assembly.

Figure 9:
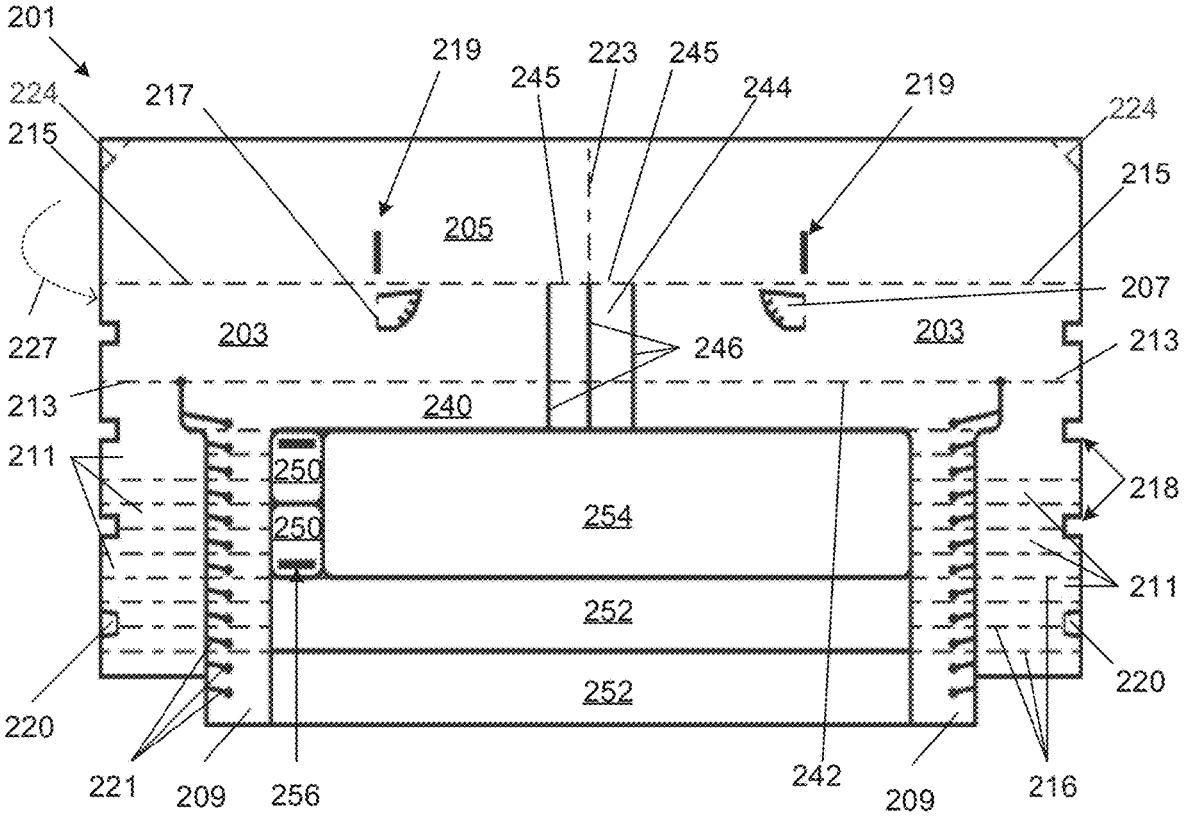
FIG. 9 illustrates a blank including additional complimentary components that may be folded to form a baffle assembly according to a second exemplary embodiment of the invention.

The blank may additionally include complementary components such as at least one covering unit (250), base blockers (252) and an instruction panel (254) as illustrated in FIG. 9. Each of the additional complimentary components may be provided in the blank (201) and bordered by cut lines, frangible connections or the like so as to facilitate removal thereof from the blank. The complimentary components may be necessary in order to provide the desired result which the baffle assembly intends to perform, i.e. to manipulate airflow within the container. For example, if a void which is formed within the baffle assembly by one of the cut-outs is not sufficiently closed, the air may flow therethrough and thereby prevent the baffle assembly from effectively manipulating airflow. Similarly, openings at the bottom of pallets or other cargo items may also provide an additional flow path for the air and should be blocked or at least partially sealed off.

A number of covering units (250) matching the number of angle selectors (207) may be provided. The covering units may be shaped and dimensioned to cover a void (253) formed by the cut-out of the relevant angle selector (207) when it is in the upright position. Each covering unit (250) includes an opening (256) configured to enable the relevant angle selector (207) to penetrate therethrough so as to facilitate mounting of the covering unit (250) onto the angle selector (207). The covering unit (250) may provide the added advantage of supporting the angle selector (207) when it is in the upright position.

The base blockers (252) may be used to prevent air flow through bases of cargo items such as openings in pallets for forklift forks or hand jacks. The base blockers (252) may be placed between the bases of adjacent cargo items so as to block an air flow path created by the openings.

The blank (201) may further include an instruction panel (254) including a set of instructions for guiding a user through the process of assembling the baffle assembly (200). The set of instructions may contain information such as folding techniques, storing recommendations, and explanations of the different parts and fold lines or the like. It should be appreciated that such information may also be provided in a booklet and that the instruction panel (254) may simply contain a logo or name of a company or organisation and need not be limited to a panel providing instructions to a user.

Figure 16:
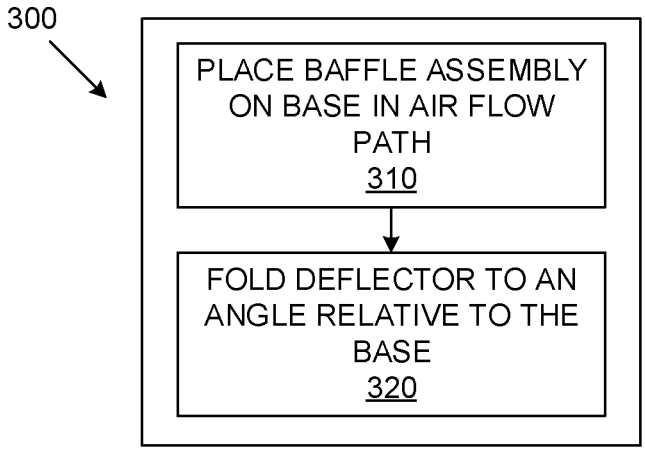
FIG. 16 is a flow diagram which illustrates an exemplary method for installing a baffle assembly according to an embodiment of the invention excluding angle selectors.

A method (300) for deploying the baffle assembly (200) in the storage container is illustrated in FIG. 16. In its simplest form the method (300) may include a user installing the baffle assembly (200) by placing (310) the baffle assembly atop a cargo item within a container. The user may fold (320) the deflector (205) about the hinge connection connecting it to the base (203) in the direction of the base (203) such that the deflector at least partially disrupts an air flow path atop the item. The deflector (205) may either be urged into an operative angular position relative to the base (203) by the incident air flow thereon. Alternatively, the material may be somewhat resilient which may cause the deflector (205) to move to an operative angular position due to the forces present in the material itself. In some embodiments, the hinged connection may be a hinge that holds deflector (205) in a selected condition, due to friction for example.

Figure 17:
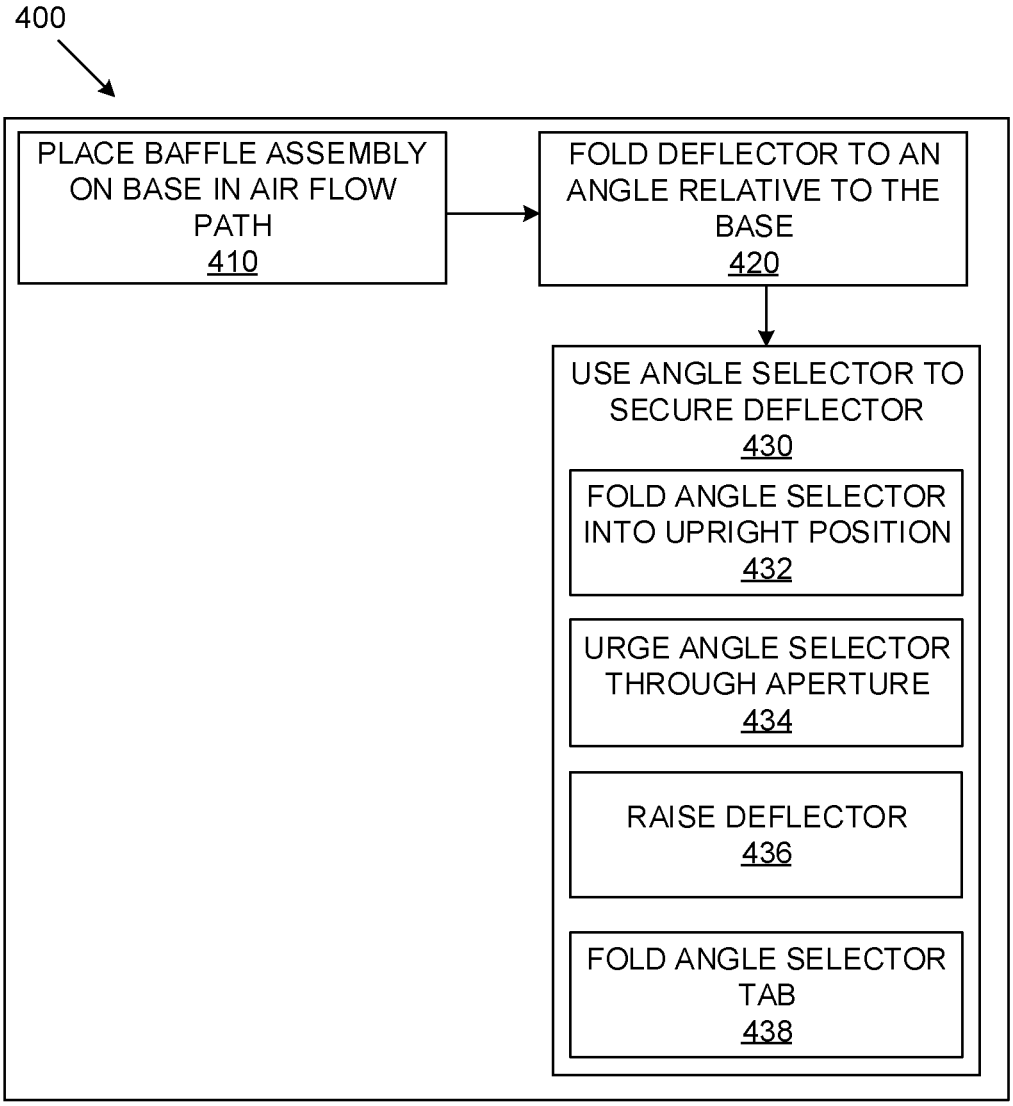
FIG. 17 is a flow diagram which illustrates an exemplary method for installing a baffle assembly according to the first and second embodiments of the invention.

A method (400) for deploying a baffle assembly (200), which includes at least one angle selector (207), in the storage container is illustrated in FIG. 17. The user may install the baffle assembly by placing (410) the baffle assembly on the base atop a cargo item at least partially in an air flow path in the container and fold (420) the deflector (205) about the hinge connection connecting it to the base in the direction of the base (203). In order to prevent the deflector from collapsing onto the base, the user may secure the deflector at an angle relative to the base (203) by using (430) the angle selector (207). Using (430) the angle selector (207) may include folding (432) the angle selector (207) into an upright position in which the angle selector extends substantially perpendicular from the base (203). The angle selector (207) may then be urged (434) through the complementary shaped aperture (219) provided in the deflector (205). In order to secure the deflector (205) at a selected angle the user may raise (436) the deflector (205) to the selected angle and an angle selector tab (231) provided on an arcuate edge of the angle selector (207) may then be folded (438) transverse the aperture (219) thereby securing the deflector at the selected angle.

It will be apparent that multiple baffle assemblies according to the invention may be installed in a refrigeration container. This may interfere with undesired air flow paths at multiple locations within the container. It is further envisaged that baffle assemblies of the present invention may be installed at the sides of items as well, and not only at the top thereof. While suitable anchor members may need to be provided, the use of the present invention is not limited to the baffle assembly being located at the roof side of a container.

The size of the baffle assembly may be such that it is able to extend across the width of a standard storage container, including intermodal containers that are manufactured in terms of ISO standards such as ISO 668 and ISO 6436. Typically the baffle assembly will be used in a standard refrigeration container, but baffle assemblies of the present invention may be provided in different sizes so that they may be placed in any desired container.

The baffle assembly need not include a foldable section as shown and described above. The angle selector may be provided in the base, and a single fold line between the base and the deflector may be sufficient.

Any suitable type of angle selector, with associated hold formations, may be provided to retain the deflector at an angle to the base.

While corrugated cardboard is indicated as being used in the above embodiments, other types of cardboard or suitable material may be used. The baffle assembly need not be provided in the form of a blank, but may be a fixed structure made from, for example, plastics material. Such a baffle assembly may still allow a user to adjust the angle at which the deflector protrudes from the base, by providing a suitable angle selector and deflector. The angle selector may also provide only a fixed angle at which the deflector may extend form the base. The deflector may then be provided without the ability to move it into a collapsed condition. Then, a rigid connection between the deflector and the baffle assembly may act as angle selector, and a separate angle selector need not be provided.

It is also envisaged that the baffle blank may be pre-configured into an intermediate configuration to allow rapid deployment. In this intermediate configuration, the baffle blank may already be folded about its fold lines as described above with the angle selectors pre-inserted into their respective slots. This may allow the user, when deploying the baffle blank, to simply unfold the deflector into a desired angle relative to the base and secure the deflector at a selected angle by means of the angle selector. This may reduce the dimensions of the baffle blank and thus the storage space it occupies when in its collapsed condition. The required storage space may be even further reduced, with reference to the first embodiment, by folding the two assembly units, in this intermediate configuration, along the line of perforations and cutline to allow the one assembly unit to be folded onto the other.

The baffle blank and the baffle assembly into which it is configured therefore provides a light and easily installable baffle that is effective in manipulating the airflow of cooled air in a refrigerated environment, requires no further tools to install and is not susceptible to puncture damage. Being lightweight, particularly if manufactured from cardboard, allows multiple baffle assemblies to be installed in a shipping container with the added weight of the baffle assemblies being negligible. What is more, since the baffle is, in some embodiments, provided as planar blank, it allows the baffle blank to assume a flat and stackable form-factor. This may allow the bulk transport of the baffle blank itself in a manner that maximises spatial efficiency. The baffle blank and thus the baffle assembly may furthermore be manufactured from a bio-degradable, recyclable, and sustainable material.

Throughout the specification and claims unless the contents requires otherwise the word 'comprise' or variations such as 'comprises' or 'comprising' will be understood to imply the inclusion of a stated integer or group of integers but not the exclusion of any other integer or group of integers.

The invention claimed is:

1. A baffle assembly manufactured from a sheet of planar material for manipulating air flow in a container, the baffle assembly comprising:

a base portion configured to support the baffle assembly in an air flow path in a container;

a deflector portion hingedly extending from the base portion; and an angle selector portion extending from one of the base portion or the deflector portion, the angle selector portion arranged to engage with another of the base portion or the deflector portion for securing the deflector portion at a selected angle relative to the base portion, and wherein the baffle assembly is operable between a collapsed condition in which the base portion, the deflector portion, and the angle selector portion lie substantially in a planar configuration, and a deployed condition in which the deflector portion is secured at the selected angle by the angle selector portion engaging with the base portion or the deflector portion so as to facilitate manipulation of an air flow incident to the deflector portion, wherein the angle selector portion is formed by a hinged cut-out with an at least partially arcuate shape or angled shape provided on one of the base portion or the deflector portion, wherein the other of the base portion or the deflector portion includes a complimentary shaped aperture configured to receive the angle selector portion.

2. The baffle assembly as claimed in claim 1, wherein the base portion includes a plurality of fold sections forming a height adjustment mechanism configured to increase a height of the base portion when at least one of the plurality of fold sections is in a substantially upright position.

3. The baffle assembly as claimed in claim 2, wherein:

individual fold sections of the plurality of fold sections have one or more notches defined at a side of the individual fold sections, such that at least some of the one or more notches are aligned when the plurality of fold sections are in a stacked configuration; and at least one of the plurality of fold sections includes a securing tab configured to be wedged into the one or more notches to secure the plurality of fold sections in a selected configuration.

4. The baffle assembly as claimed in claim 1, wherein the angle selector portion includes a plurality of foldable angle selector tabs, each foldable angle selector tab being operable to secure the deflector portion at the selected angle relative to the base portion by folding the plurality of foldable angle selector tabs transverse to the complimentary shaped aperture.

5. The baffle assembly as claimed in claim 1, wherein one of the base portion or the deflector portion includes a plurality of angle selector portions integrally formed therewith.

6. The baffle assembly as claimed in claim 1, further comprising at least one covering unit having an opening for mounting each covering unit onto a corresponding angle selector portion to at least partially cover a void formed by the hinged cut-out of the relevant angle selector portion.

7. The baffle assembly as claimed in claim 1, wherein the planar material includes at least one of a corrugate or paper-based material.

8. The baffle assembly as claimed in claim 1, wherein the angle selector portion has one or more shoulders on which a surface of the base portion or the deflector portion rests to dispose the deflector portion at the selected angle.

9. The baffle assembly as claimed in claim 1, wherein the angle selector portion is configured to extend at least partially through an aperture formed in the base portion or the deflector portion.

10. A baffle blank of planar sheet material having fold lines, cut lines, sulcations arranged to form a base, a deflector extending from the base along a hinge line, and an angle selector formed as cut-out in the baffle blank, wherein the baffle blank of planar sheet material is operable into a deployed baffle assembly in which the deflector is secured at a selected angle among a plurality of angles relative to the base by at least one angle selector support tab of the angle selector engaging with either the deflector or the base, the angle selector extending between the base and the deflector and at least partially through an aperture in the deflector or the base.

11. The baffle blank as claimed in claim 10, wherein:

the base, the deflector, and the angle selector are integrally formed; and the angle selector is formed as a hinged cut-out in either the base or the deflector.

12. The baffle blank as claimed in claim 10, wherein the planar sheet material includes at least one of a corrugate or paper-based material.

13. The baffle blank as claimed in claim 10, further comprising one or more anchor members extending from the base, wherein when the baffle blank of planar material is operable into the deployed baffle assembly, the one or more anchor members extend from the base in a direction opposite a direction in which the angle selector extends from the base.

* * * * *